US005216950A

United States Patent [19]

Gugel et al.

[11] Patent Number: 5,216,950

[45] Date of Patent: Jun. 8, 1993

[54] VIBRATION FRAME FOR PRINT ELEMENTS OF A MATRIX LINE PRINTER

[75] Inventors: Bernd Gugel, Ulm-Einsingen; Johann Stempfle, Pfaffenhofen, both of Fed. Rep. of Germany

[73] Assignee: Mannesmann Aktiengesellschaft, Düsseldorf, Fed. Rep. of Germany

[21] Appl. No.: 478,275

[22] Filed: Feb. 9, 1990

[30] Foreign Application Priority Data

Feb. 14, 1989 [EP] European Pat. Off. ..... 89730028.1

[51] Int. Cl.[5] ..... B41J 2/245

[52] U.S. Cl. ..... 101/93.05; 400/124

[58] Field of Search ..... 101/93.04, 93.05, 93.29, 101/93.30, 93.31, 93.32, 93.33, 93.34; 400/124, 121, 157.2

[56] References Cited

U.S. PATENT DOCUMENTS

| | | | |
|---|---|---|---|
| 3,169,473 | 2/1965 | Irwin et al. | 101/93.33 |
| 3,745,917 | 7/1973 | Cavella | 101/93.34 |
| 3,964,384 | 6/1976 | Johnston | 101/93.29 |
| 3,981,236 | 9/1976 | Johnston et al. | 101/93.34 |
| 4,375,338 | 3/1983 | Mitsuishi | 101/93.05 |
| 4,441,421 | 4/1984 | Khorsand | 101/93.04 |
| 4,444,519 | 4/1984 | Howell et al. | 101/93.04 |
| 4,532,862 | 8/1985 | Moss | 101/93.32 |
| 4,539,905 | 9/1985 | Zenner | 101/93.05 |
| 4,569,605 | 2/1986 | Meier et al. | 400/124 |
| 4,626,115 | 12/1986 | Norigoe | 400/124 |
| 4,793,252 | 12/1988 | Pilcher | 101/93.05 |
| 4,852,480 | 8/1989 | Kunita et al. | 101/93.05 |
| 5,033,885 | 7/1991 | Gugel et al. | 400/124 |

FOREIGN PATENT DOCUMENTS

| | | | |
|---|---|---|---|
| 7827095 | 11/1979 | Fed. Rep. of Germany | 400/124 |
| 95480 | 6/1982 | Japan | 400/124 |
| 98366 | 6/1982 | Japan | 101/93.05 |
| 126673 | 8/1982 | Japan | 400/124 |
| 179265 | 9/1985 | Japan | 101/93.05 |
| 54945 | 3/1986 | Japan | 101/93.05 |
| 44461 | 2/1987 | Japan | 400/124 |

*Primary Examiner*—David A. Wiecking
*Attorney, Agent, or Firm*—Horst M. Kasper

[57] ABSTRACT

In a vibration frame (1) for print elements (2) of a matrix line printer, the print elements (2) are furnished in the clapper armature construction. The print elements (2) form neighboring component units in line direction (3) in or, respectively, at a profile rod (7). Said component units include, in each case, a magnetic yoke (8), an electromagnetic coil (9), a clapper armature (10), a clapper armature pivoting hinge support (11), a restoring spring (12), and print elements (2) attached at the clapper armature (10). In order to create a space-saving lateral guiding for the clapper armature (10), the clapper armature (10) is, in each case, laterally guided and pivotably movable by at least one tongue (15), extending perpendicular to the longitudinal extension and engaging into a recess (16). The restoring spring (12) is formed as an arm spring (17). The arm spring (17) forms with a spring arm (18) a second lateral guide for the clapper armature (10).

40 Claims, 3 Drawing Sheets

VIBRATION FRAME FOR PRINT ELEMENTS OF A MATRIX LINE PRINTER

BACKGROUND OF THE INVENTION

1. Field of the Invention

The invention relates to a vibration frame for the print elements of a matrix-line printer, which print elements are constructed according to the clapper armature construction. Component units, neighboring in line direction, are furnished at a profile rod. Said component units include, in each case, a magnetic yoke, an electromagnetic coil, a clapper armature, a clapper-armature pivoting hinge support, a restoring spring, and a print element attached at the clapper armature.

2. Brief Description of the Background of the Invention Including Prior Art

Such matrix line printers serve mainly for printing out of a high data output generated by an electronic computer, and such matrix line printers are consequently coordinated to a computer, where the volume of data corresponds to that of a mini-computer or, respectively, of a main frame computer.

In contrast to serial printers, matrix line printers generate dot lines in line direction, where a series of horizontal dot lines are necessary for the formation of a complete character line or of a section of a picture. Therefore, conventionally only one dot print element is disposed in the advance direction of the recording material for several character columns. According to a conventional matrix line printer, such as Mannesmann Tally MT 660/MT 690, there are provided 66 or, respectively, 132 print elements. Such a matrix line printer prints between 600 and 900 lines per minute in high-speed mode and about 280 to 450 lines in letter-quality mode.

The initially mentioned vibration frame for the print elements of a matrix line printer is known from the European Patent Publication No. 0,098,316.

The conventional construction provides that the electromagnets are formed as clapper armature magnets and that the vibration frame comprises a profile rod, extending in the line direction, where the larger, open cross-sectional part of the profile rod faces the print roller. The cross-sectional part is formed by three sides of a rectangle including wall sections. One wall section of the rectangular cross-sectional part continues at its free end, facing the print roller side, in a smaller cross-sectional part of the profile rod. Said smaller cross-sectional part of the profile rod is delimited by three sides of a rectangle forming wall sections and includes an open side. The open side of the smaller cross-sectional part is neighboring to the open side of the larger cross-sectional part and runs with its open plane perpendicular to the open side of the larger cross-sectional part. The magnetic yoke and the electromagnetic coil are disposed in the larger cross-sectional part and the clapper armature at the open side while, in each case, a short print pin, the clapper armature tip, extending through the open side of this cross-sectional part, and a set screw for the clapper armature, are received in the smaller cross-sectional part. Based on this construction, however, the clapper armature is not positioned in a defined manner and the danger exists that a lateral motion interferes with the mode of operation of the clapper armature, such that the desired high frequency of the clapper armature construction cannot be achieved.

SUMMARY OF THE INVENTION

1. Purposes of the Invention

It is an object of the invention to provide a matrix line printer, where the side position of the individual print elements is clearly defined.

It is another object of the invention to provide a clapper armature which can be assembled by employing springs and which avoids the use of bolting elements.

It is yet a further object of the present invention to employ restoring springs in order to clearly define the position of the clapper armature and to actuate the print pin.

These and other objects and advantages of the present invention will become evident from the description which follows.

2. Brief Description of the Invention

The present invention provides for a vibration frame for print elements of a matrix line printer. The print elements are of a clapper armature construction. Neighboring construction units are furnished in or, respectively, at the profile rod in line direction. The construction units include, in each case, a magnetic yoke, an electromagnetic coil and a clapper armature including a tongue. The tongue is disposed perpendicular to the longitudinal extension of the clapper armature. The tongue engages into a recess and said recess thereby provides a guide to the tongue. There is further included a clapper armature pivoting hinge support. A restoring spring is furnished as an arm spring. Said arm spring with one spring arm forms a second lateral guide for the clapper armature. A print element is attached to the clapper armature. The clapper armature, in each case, is laterally guided and tiltably movable by way of the tongue of the clapper armature.

The magnetic yokes with the electromagnetic coil can be attached at the profile rod. A detent rod, disposed opposite to a clapper armature end, guided by way of the arm spring, and extending throughout in line direction can be attached at the profile rod.

The clapper armature and the clapper armature pivoting hinge support can be disposed in the front casing part. The front casing part can be fixed in position relative to the profile rod and can be disengageably and demountably connected to the profile rod. The clapper armature pivoting hinge support can be formed by an elastic strand with an 0 cross-section. The front casing part can be fixed with at least one rib, where the rib can engage into a groove-shaped recess at the profile rod. The front casing part and the profile rod can be disengageably connected to each other by way of one or several spring bands.

The recess, in which the clapper armature engages with its tongue, can be disposed in an arm of the magnetic yoke.

The arm springs can be connected to each other in line direction. The spring arm of the arm spring, facing the clapper armature, can be furnished with a U-shaped guide surrounding the armature cross-section. The spring arm of the arm spring, facing away from the clapper armature, can be furnished with openings for the passage of the print elements.

By means of at least one tongue, disposed perpendicular to the longitudinal extension of the clapper armature, the clapper armature engages, in each case, in a recess and is laterally guided and pivotable. The restoring spring is formed as an arm spring. The arm spring forms with the arm end a second lateral guide means for the clapper armature. Such a construction is associated with the twofold advantage of a double guide, i.e., on the one hand, a guidance by the tongue disposed perpendicular to the longitudinal extension of the clapper armature and, on the other hand, a guidance by the second, lateral guide of an arm spring.

According to a further embodiment of the invention, it is provided that the magnet yoke with electromagnetic coil and a detent rod are disposed in the profile rod. Said detent rod is disposed opposite to the clapper armature end guided by means of the arm spring, and extends generally in line direction. Both the electromagnetic coils as well as the detent rod can therefore be easily mounted from an open side of the profile rod and, if desired, can be machined to form one single plane.

A further improvement according to the invention is that the clapper armatures and an elastic strand with an O cross-section, forming the clapper armature pivoting hinge support, are disposed in a front casing part, Said front casing part is fixed relative to the profile rod and is detachably connected with the profile rod. The subdivision into two parts of the front casing part and the profile rod itself allows an easy and uncomplicated mounting and assembly, where no movable parts have to be mounted in the rear casing part, furnished by the profile rod. In addition, it is particularly advantageous for service work if it is possible to simply remove the front casing part in order to be able to reach the essential component units in the interior of the vibration frame without destroying the adjustment.

According to a further embodiment, the invention provides that the front casing part is fixed with at least one rib engaging in a groove-shaped recess at the profile rod. Both the groove-shaped recess as well as the profile rod define the front casing part relative to the profile rod with respect to tolerances such that, in case of disassembly and assembly, a precise position of all parts can be achieved as many times as desired.

A further improvement disclosed by the invention includes that the front casing part and the profile rod are detachably connected to each other by way of one or several spring bow clips. The spring bow clips allow for a simple, quick, and repeated detaching or, respectively, attaching of the front casing part at the profile rod.

According to a further feature of the invention, it is provided that the recess, into which the clapper armature engages with its tongue, is disposed in an arm of the magnetic yoke. Because of the extension of the electromagnetic coil, a certain width of the magnetic yoke arm is always available. Consequently, it is particularly space saving relative to the sides to employ one of the two arms of the magnetic yoke for the recess according to the invention in order to thereby create a more compact construction of the overall vibration frame.

The present invention further discloses another improvement comprising that the arm springs are connected to each other in line direction. This construction results in a single stamped part and in a very precise determination of the spacings of the clapper armatures, which can be achieved based on the single-piece arm spring body.

The lateral guidance of the clapper armature can also be improved by providing the spring arm of the arm spring facing the clapper armature, with a U-shaped guide surrounding the armature cross-section.

Furthermore, additional space can be saved by furnishing openings for the passage of the print elements on the spring arm of the arm spring facing away from the clapper armature.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
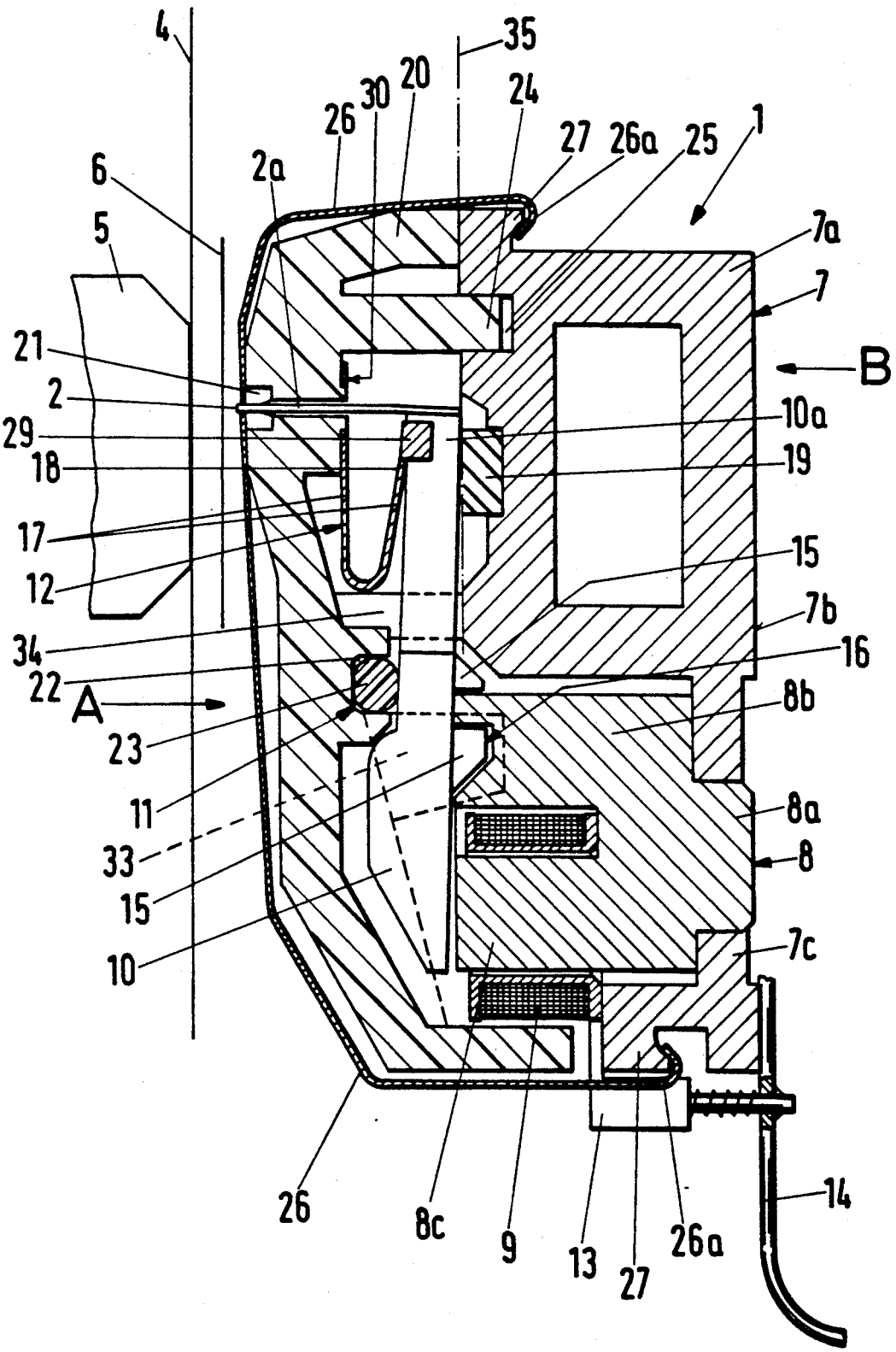
FIG. 1 is a vertical cross-sectional view through the completely assembled vibration frame.

According to the present invention, there is provided a vibration frame 1 for print elements 2 of a matrix line printer. The print elements 2 are of a clapper armature construction. Neighboring construction units are furnished in or, respectively, at a profile rod 7 in line direction 3. The construction units, in each case, include a magnetic yoke 8, an electromagnetic coil 9, a clapper armature 10, a clapper armature pivoting hinge support 11, a restoring spring 12, and a print element 2 attached to the clapper armature 10. The clapper armature 10, in each case, is laterally guided and tiltably movable by way of at least one tongue 15. The tongue 15 is disposed perpendicular to the longitudinal extension of the clapper armature 10 and engages into a recess 16. The restoring spring 12 is furnished as an arm spring 17. The arm spring 17 with one spring arm 18 forms a second lateral guide for the clapper armature 10.

The magnetic yokes 8 with the electromagnetic coils 9 can be attached at the profile rod 7. A detent rod 19, disposed opposite to a clapper armature end 10*a*, guided by way of the arm spring 17, and extending throughout in line direction 3, can be attached at the profile rod 7.

The clapper armature 10 and an elastic strand 23 with an O-cross-section, forming the clapper armature pivoting hinge support 11, can be disposed in a front casing part 20. The front casing part 20 can be fixed in position relative to the profile rod 7 and and can be detachably and demountably connected to the profile rod 7. The front casing part 20 can be fixed with at least one rib 24 engaging into a groove-shaped recess 25 at the profile rod 7. The front casing part 20 and the profile rod 7 can be detachably connected to each other by way of one or several spring bands 26.

The recess 16, in which the clapper armature 10 engages with its tongue 15, can be disposed in an arm 8*b* of the magnetic yoke 8.

The arm springs 17 can be connected to each other in line direction 3. The spring arm 18 of the arm spring 17, facing the clapper armature 10, can be furnished with a U-shaped guide 29 surrounding the armature cross-section. The spring arm 30 of the arm spring 17, facing away from the clapper armature 10, can be furnished with openings 31 for the passage of the print elements 2.

Figure 2:
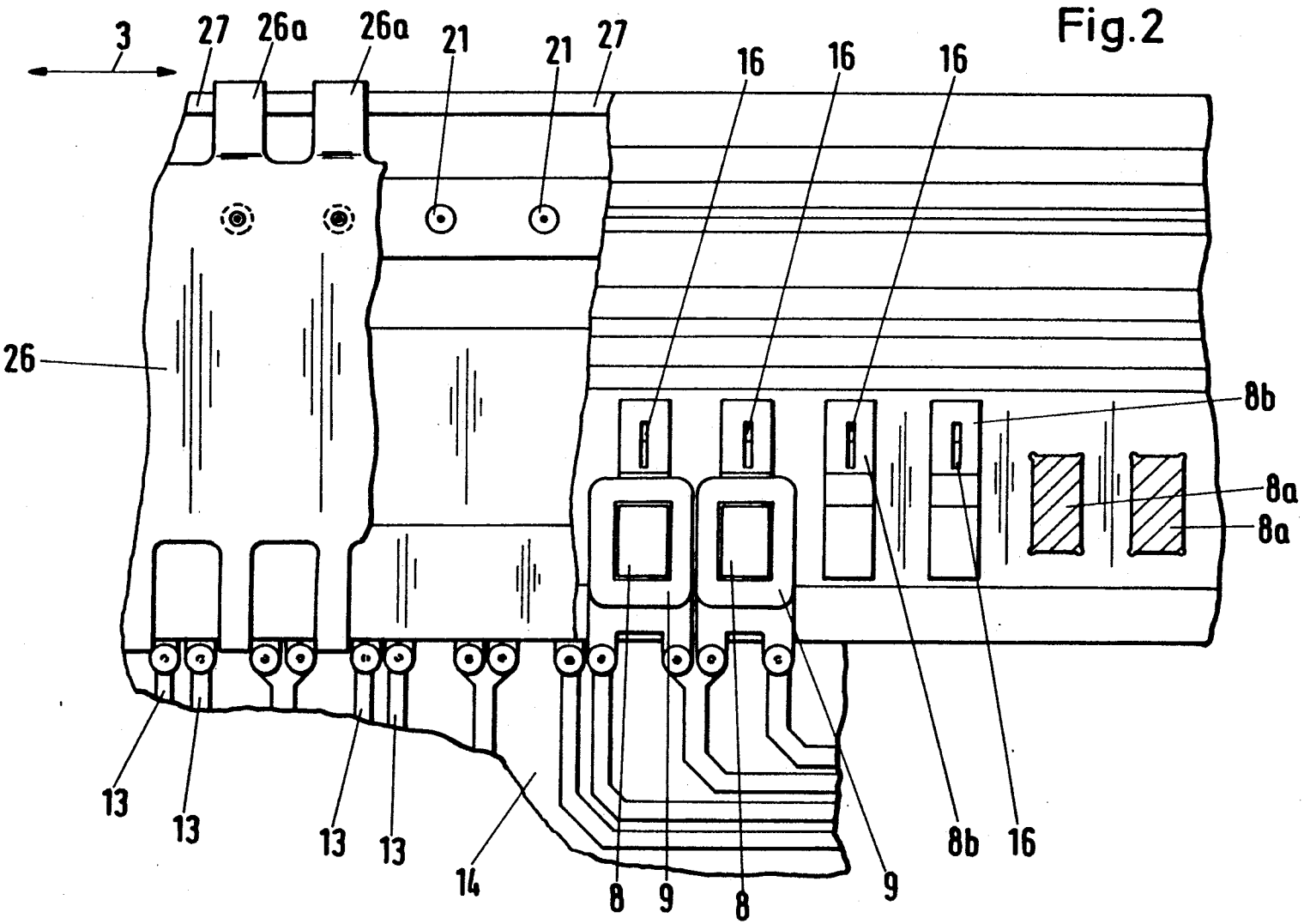
FIG. 2 is a front elevational view in the direction A of the vibration frame according to FIG. 1.

Only the vibration frame 1 of the matrix line printer is illustrated. This vibration frame 1 is associated with a vibration drive, not illustrated here. The vibration drive comprises an electromechanic drive unit, which generates in principle an about sinusoidal vibratory movement. The matrix print process occurs in the substantially rectilinear section of the modified sine curve. The vibratory motion of the vibration frame 1 requires only a minimum path of back and forth motion or pendulum motion, which can amount, according to the practical embodiment, to about 10 to 15 mm, i.e. one to three times the character width of a character. For this purpose, the print elements 2 are disposed next to each other in line direction 3, as illustrated in FIG. 2. The recording material 4 runs perpendicular to the line direction 3, and the recording material 4 rests fully and reliably on the print counter support 5. An ink ribbon 6 is disposed between the vibration frame 1 and the print counter support 5 or, respectively, the recording material 4.

A profile rod 7 includes an upper box part 7*a*. A wall plate 7*c* follows at the rear wall 7*b* of the upper box part 7*a*. Said wall plate 7*c* extends downwardly and receives the 33, 66, or 132 component units. Said component units include in each case a magnetic yoke 8, an electromagnetic coil 9, a clapper armature 10, a clapper-armature pivoting hinge support 11, a restoring spring 12, and a print element 2 attached at the clapper armature 10. In this case, the print element 2 can, for example, include a print pin 2*a*. The magnetic yoke 8 is attached with a magnetic yoke foot 8*a* in the wall plate 7*c* and the magnetic yoke 8 includes two magnetic yoke arms 8*b* and 8*c*.

All coil feet 13 of the electromagnetic coils 9 are collected at a collection rail 14 and are soldered there to the corresponding lead wires.

The clapper armature 10 includes a tongue 15, disposed perpendicular to the longitudinal extension of the clapper armature 10 and directed from the bottom upwardly as illustrated in FIG. 1. The tongue 15 engages into a recess 16. Consequently, the clapper armature 10 does not require any lateral guide elements in the line direction 3 such that the clapper armatures, relative to their width disposition, are disposed with a small gap theoretically next to each other. The tongue 15 represents only one guide possibility which, as will be described below, can be replaced by another guide possibility, wherein however the other guide possibility does also not require any additional space in the line direction 3.

The restoring spring 12 is provided as an arm spring 17, where one spring arm 18 of the arm spring 17 forms a second lateral guide for the clapper armature 10. Such a second lateral guide for the clapper armature 10 is already generated by fixedly connecting the spring arm 18 to the clapper armature 10 which, for example, can be achieved by spot welding. The rectangular cross-section of the restoring spring 12 is of particular importance in this context.

The magnetic yokes 8 are furnished in the profile rod 7 in each case with an electromagnetic coil 9. Said electromagnetic coil 9 is attached by way of the magnetic yoke foot 8*a* and, furthermore, a detent rod 19, extending throughout in line direction 3, is also attached at the profile rod 7. This detent rod 19 is disposed opposite to the clapper armature end 10*a* guided by way of the arm spring 17. The spring arm 18 consequently presses always immediately at the clapper armature end 10*a* against the detent rod 19. Said detent rod 19 is produced from a damping material such as, for example, hard rubber or the like.

Furthermore, there is provided a front casing part 20, which is fixed in position relative to the profile rod 7 and which is detachably and demountably connected with the profile rod 7. The front casing part 20 can be injection-molded of plastic and consequently is magnetically non-conductive and in particular does not exhibit any ferromagnetic properties. For each print element 2 or, respectively, each print pin 2*a*, a guide peg or guide stone 21 is pressed into the front casing part 20 in the region of the ink ribbon 6. Said guide stone 21 is made of a ruby or an extremely hard material, which decreases the frictional wear. All clapper armatures 10 are pivotably supported and resting at the clapper armature pivoting hinge support 11. Said clapper armature pivoting hinge support 11 is formed by a guide groove 22 for an elastic strand 23 with an O-cross-section.

Figure 3:
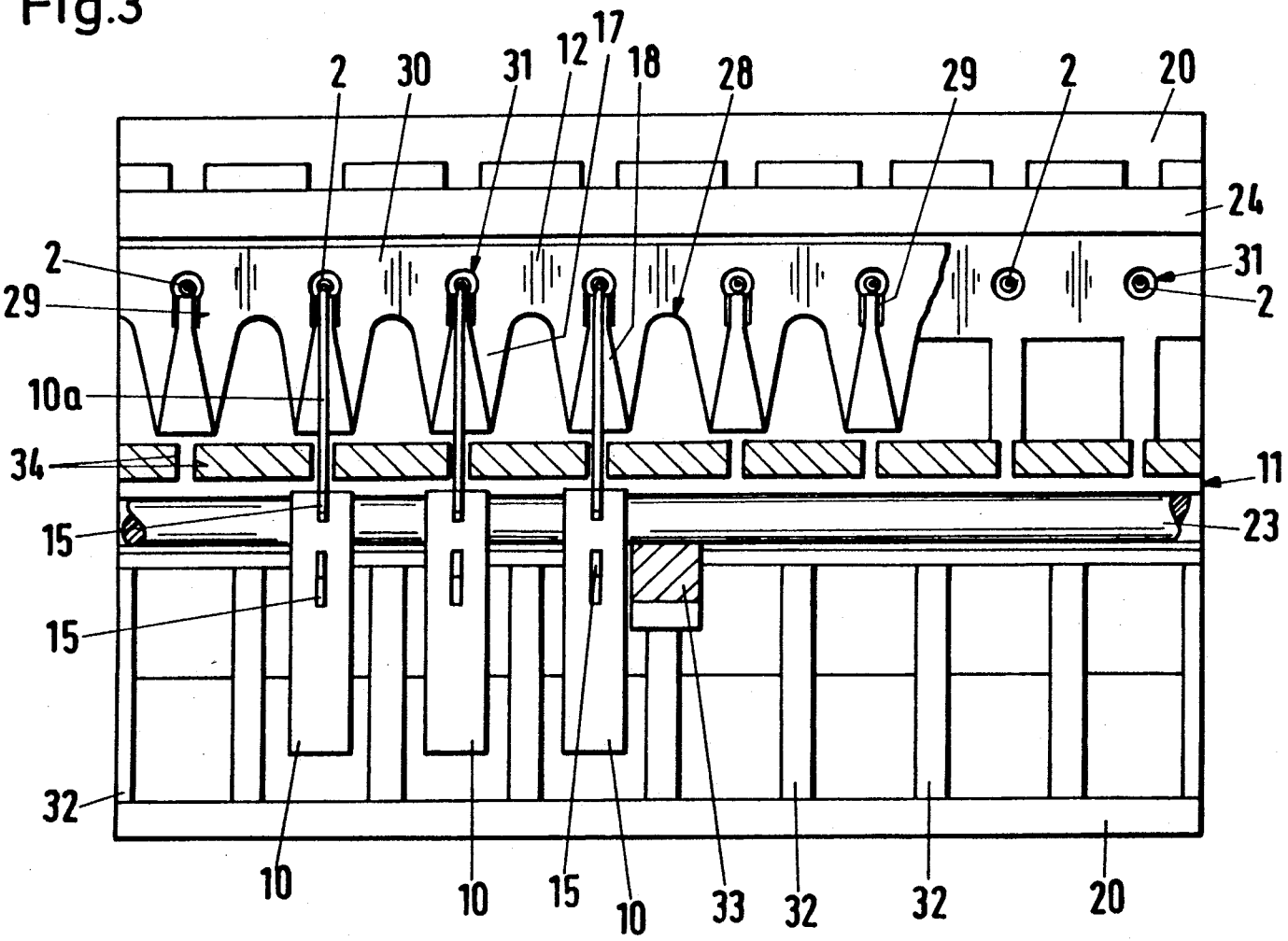
FIG. 3 is rear elevational view of the vibration frame in the direction B according to FIG. 1, however without the presence of the profile rod with the electromagnetic coils.

The front casing part 20 is fixed in its position relative to the profile rod 7 with a rib 24, produced in a planar parallel shape. A groove-shaped recess 25 with corresponding tolerances is furnished in the profile rod 7. The casing part 20 is fixed in line direction 3 by way of a further guide 33 relative to the profile rod 7. The further guide 33 engages between two magnetic yokes 8, as illustrated in FIG. 3 or, respectively, in FIG. 1. In addition, support faces 34 are furnished on the sides of the clapper armature ends 10*a*.

The front casing part 20 and the profile rod 7 are disengageably connected to each other by way of one or several spring bow clips 26. Such a spring bow clip 26, in each case, engages with one bent end 26*a* around an undercut strip 27 of the profile rod 7.

As was already recited, the tongue 15 can have added a further tongue 15, where the corresponding recess 16, into which recess 16 the clapper armature 10 engages with its tongue 15, is disposed in an arm 8*b* of the magnetic yoke 8.

The arm springs 17 can be connected to each other in line direction 3, as is illustrated in FIG. 3. In this context, the individual arm springs 17 are attached to each other by a curved connection 28.

In addition, the spring arms 18 of the arm spring 17, facing in each case the clapper armature 10, are furnished with a U-shaped guide 29 surrounding the cross-section of the armature in its width or thickness. The spring arm 30, facing away from the clapper armature 10, includes openings 31 for the passage of the print elements 2. The stiffness of the front casing parts 20 is further increased by individual ribs 32, which are cast to the front casing part 20. The front casing part 20, the detent rod 19, and the profile rod 7 form in the region of the upper box part 7*a* a joint plane 35 in addition to the lateral defining of the clapper armature.

It will be understood that each of the elements described above, or two or more together, may also find a useful application in other types of frames for print elements differing from the types described above.

While the invention has been illustrated and described as embodied in the context of a vibration frame for print element of a matrix line printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A supported print element structure of a matrix line printer, comprising a profile rod in line direction;

print units including a magnetic yoke;

an electromagnetic coil;

a clapper armature;

a clapper armature pivoting hinge support;

a restoring spring furnished as an arm spring having a first spring arm and having a second arm, wherein the second arm of the arm spring forms a lateral guide for the clapper armature and wherein the first spring arm of the arm spring is furnished with a hole for surrounding a print element;

a front casing part having a hole for passing a print pin and a print element attached to the clapper armature wherein the clapper armature in each case, is laterally guided and tiltably movable.

2. The supported print element structure according to claim 1 further comprising a detent rod, wherein the magnetic yoke with the electromagnetic coil is attached at the profile rod and where the detent rod, disposed opposite to a clapper armature end guided by way of the arm spring, and extending throughout in line direction is attached at the profile rod.

3. The supported print element structure according to claim 1, wherein the front casing part is formed separate relative to the profile rod and solidly attached to the profile rod, wherein the clapper armature and the clapper armature pivoting hinge support are disposed in the front casing part, where the front casing part is fixed in position relative to the profile rod and is disengageably and demountably connected to the profile rod.

4. The supported print element structure according to claim 3, wherein the clapper armature pivoting hinge support is formed by an elastic strand with an O cross-section.

5. The supported print element structure according to claim 3, wherein the front casing part is fixed with at least one rib, where the rib engages into a groove-shaped recess at the profile rod.

6. The supported print element structure according to claim 3, wherein the front casing part and the profile rod are disengageably connected to each other by way of one or several spring bands.

7. The supported print element structure according to claim 1, wherein the arm springs are connected to each other in line direction.

8. The supported print element structure according to claim 1, wherein the second spring arm of the arm spring faces the clapper armature, and wherein the second spring arm is furnished with a U-shaped guide surrounding the armature cross-section.

9. The supported print element structure according to claim 1 further comprising a projection surrounding the hole in the front casing part in a direction toward the armature;

a step in the projection wherein the base of the step provides a rest face for the first spring arm of the arm spring, wherein a rise of the step engages the hole in the first spring arm, and wherein an upper level of the step is substantially flush with the rest face directed toward the armature thereby locking the first spring arm in a disengageable position at the front casing part, wherein the front casing part is fixed with at least one rib to the profile rod, wherein the rib engages into a groove-shaped recess at the profile rod, wherein the projection surrounding the hole is disposed next to the rib.

10. The supported print element structure according to claim 1 further comprising a front casing part;

a spring band, wherein the spring band attaches the front casing part to the profile rod such that the front casing part and the profile rod are disengageably connected to each other, wherein the spring band has a first end and a second end and wherein the first end of the spring band is bent to form a first hook and wherein the second end of the spring band is bent to form a second hook, wherein the profile rod is furnished with a first recess and with a second recess and wherein the first hook engages the first recess from the rear of the profile rod and wherein the second hook engages the second recess from the rear of the profile rod and wherein the spring band surrounds the front casing part such that the front casing part is attached to the profile rod, and wherein the spring band is furnished with a hole aligned with the hole of the front casing part for allowing passage of the print element moving through the front casing part and through the spring band.

11. The supported print element structure according to claim 1 further comprising wherein the clapper armature includes a tongue, wherein the tongue is disposed perpendicular to the longitudinal extension of the clapper armature and wherein the tongue engages into a recess and said recess thereby providing a guide to the tongue.

12. A supported print element structure of a matrix line printer, comprising a profile rod in line direction;

print units including a magnetic yoke;

an electromagnetic coil;

a clapper armature;

a clapper armature pivoting hinge support;

a restoring spring furnished as an arm spring having a first arm and having a second arm, wherein the second arm of the arm spring forms a lateral guide for the clapper armature; and a print element attached to the clapper armature wherein the clapper armature in each case, is laterally guided and tiltably movable;

a front casing attached to the profile rod having a thickened region surrounding a hole for the print element and having a stepped projection around the hole on the side toward the armature and wherein the first arm of the restoring spring is furnished with a hole matching the periphery of the projection for locking the second arm to the casing.

13. The supported print element structure according to claim 12 further comprising a tongue formed at the clapper armature, wherein the tongue is disposed perpendicular to a longitudinal extension of the clapper armature and wherein the tongue engages into a recess and said recess thereby providing a guide to the tongue; and wherein the recess, in which the clapper armature engages with its tongue, is disposed in an arm of the magnetic yoke.

14. A supported print element structure of a matrix line printer, comprising a profile rod in line direction;

print units including a magnetic yoke;

an electromagnetic coil;

a clapper armature;

a clapper armature pivoting hinge support;

a restoring spring furnished as an arm spring having a first arm and having a second arm, wherein the first arm of the arm spring is furnished with a hole for fixing the position of the first arm of the arm spring in a position substantially parallel to a position of the second arm of the arm spring and wherein the second arm of the arm spring forms a lateral guide for the clapper armature; and a print element attached to the clapper armature wherein the clapper armature in each case, is laterally guided and tiltably movable; wherein the spring arm of the arm spring, facing the clapper armature, is furnished with a U-shaped guide surrounding the armature cross-section, and wherein the spring arm of the arm spring, facing away from the clapper armature, is furnished with an opening for a passage of the print elements.

15. The supported print element structure according to claim 14 further comprising a tongue disposed at the clapper armature, wherein the tongue is disposed perpendicular to the longitudinal extension of the clapper armature and wherein the tongue engages into a recess and said recess thereby providing a guide to the tongue.

16. A supported print element structure (1, 2) of a matrix line printer, wherein neighboring print units are furnished at a profile rod (7) in line direction (3), which print units, in each case, include a magnetic yoke (8), an electromagnetic coil (9), a clapper armature (10), a clapper armature pivoting hinge support (11), a restoring spring (12), and a print element (2) attached to the clapper armature (10), wherein the clapper armatures provide print pin actuators, wherein the restoring spring (12) is furnished as an arm spring (17), which arm spring (17) forms a lateral guide for the clapper armature (10) with a second spring arm (18) and wherein the arm spring is attached to a casing by surrounding a protrusion around a hole in the casing for the print element with a hole in a first spring arm of the arm spring (18).

17. The supported print element structure according to claim 16, wherein the magnetic yokes (8) with the electromagnetic coil (9) are attached at the profile rod (7) and where a detent rod (19), disposed opposite to a clapper armature end (10*a*), guided by way of the arm spring (17), and extending throughout in line direction (3) is attached at the profile rod (7).

18. The supported print element structure according to claim 16, wherein the clapper armature (10) and an elastic strand (23) with an O-cross-section, forming the clapper armature pivoting hinge support (11) are disposed in a front casing part (20) wherein the front casing part (20) is a separate unit relative to the profile rod (7), wherein the front casing part (20) is solidly attached to the profile rod (7), and which front casing part (20) is fixed in position relative to the profile rod (7) and is detachably and demountably connected to the profile rod (7).

19. The supported print element structure according to claim 18, wherein the front casing part (20) is fixed with at least one rib (24) engaging into a groove-shaped recess (25) at the profile rod (7).

20. The supported print element structure according to claim 18, wherein the front casing part (20) and the profile rod (7) are detachably connected to each other by way of one or several spring bands (26).

21. The supported print element structure according to claim 16, wherein the arm springs (17) are connected to each other in line direction (3).

22. The supported print element structure according to claim 16, wherein the spring arm (18) of the arm spring (17), facing the clapper armature (10), is furnished with a U-shaped guide (29) surrounding the armature cross-section.

23. The supported print element structure according to claim 16, wherein the clapper armature (10), in each case, is laterally guided and tiltably movable by way of at least one tongue (15), disposed perpendicular to the longitudinal extension of the clapper armature (10), which tongue (15) engages into a recess (16).

24. A supported print element structure (1, 2) of a matrix line printer, wherein neighboring print units are furnished at a profile rod (7) in line direction (3), which print units, in each case, include a magnetic yoke (8), an electromagnetic coil (9), a clapper armature (10), a clapper armature pivoting hinge support (11), a restoring spring (12), and a print element (2) attached to the clapper armature (10), wherein the clapper armatures provide print pin actuators, wherein the restoring spring (12) is furnished as an arm spring (17), which arm spring (17) with one second spring arm (18) forms a lateral guide for the clapper armature (10), wherein the arm spring is held with a first spring arm to a casing part, wherein the casing part is furnished with a hole for the print element (2), wherein a spring bow clip attaches the front casing part to the profile rod with an upper clamp end engaging an upper recess of the profile rod from the rear and with a lower clamp end engaging a lower recess of the profile from the rear.

25. The supported print element structure according to claim 24, wherein the clapper armature (10), in each case, is laterally guided and tiltably movable by way of at least one tongue (15), disposed perpendicular to a longitudinal extension of the clapper armature (10), which tongue (15) engages into a recess (16).

26. A supported print element structure (1, 2) of a matrix line printer, wherein neighboring print units are furnished at a profile rod (7) in line direction (3), which print units, in each case, include a magnetic yoke (8), an electromagnetic coil (9), a clapper armature (10), a clapper armature pivoting hinge support (11), a restoring spring (12), and a print element (2) attached to the clapper armature (10), wherein the clapper armatures provide print pin actuators, wherein the restoring spring (12) is furnished as an arm spring (17) formed like a "U", which arm spring (17) includes a second spring arm (18) forming a lateral guide for the clapper armature (10), and wherein a first spring arm (30) of the arm spring (17), facing away from the clapper armature (10) and having an end section disposed substantially parallel to an end section of the first spring arm (30), is furnished with an opening (31) for the passage of the print element (2) and for attachment of the first spring arm at a fixed position of the print unit.

27. The supported print element structure according to claim 26, wherein the clapper armature (10), in each case, is laterally guided and tiltably movable by way of at least one tongue (15), disposed perpendicular to a longitudinal extension of the clapper armature (10), which tongue (15) engages into a recess (16).

28. A supported print element structure of a matrix line printer, comprising a profile rod in line direction;

a front casing part formed separate relative to the profile rod and form matchingly attached to the profile rod;

print units including a magnetic yoke;

an electromagnetic coil;

a clapper armature;

a clapper armature pivoting hinge support;

a restoring spring furnished as an arm spring, which arm spring with a second spring arm forms a lateral guide for the clapper armature; and a print element attached to the clapper armature wherein the clapper armature in each case, is laterally guided and tiltably movable, and wherein the print element passes through an opening of the front casing part and through an opening of a first spring arm of the arm spring.

29. The supported print element structure according to claim 28 further comprising a tongue attached at the clapper armature, wherein the tongue is disposed perpendicular to the longitudinal extension of the clapper armature and wherein the tongue engages into a recess and said recess thereby providing a guide to the tongue.

30. A supported print element structure of a matrix line printer, comprising a profile rod in line direction;

a front casing part formed separate relative to the profile rod and form matchingly attached to the profile rod;

print units including a magnetic yoke;

an electromagnetic coil;

a clapper armature;

a clapper armature pivoting hinge support;

a restoring spring furnished as an arm spring, which arm spring is formed by a first spring arm and a second spring arm, wherein the first spring arm serves for fixedly attaching the first spring arm to the front casing part, and wherein the second spring arm faces the clapper armature and forms a lateral guide for the clapper armature; and a print element attached to the clapper armature wherein the clapper armature in each case, is laterally guided and tiltably movable, and wherein the print element passes through an opening of the front casing part.

31. The supported print element structure according to claim 30, further comprising a detent rod, wherein the magnetic yoke with the electromagnetic coil is attached at the profile rod and where the detent rod, disposed opposite to a clapper armature end guided by way of the arm spring, and extending throughout in line direction is attached at the profile rod.

32. The supported print element structure according to claim 30, wherein the clapper armature and the clapper armature pivoting hinge support are disposed in the front casing part, where the front casing part is fixed in position relative to the profile rod and is disengageably and demountably connected to the profile rod.

33. The supported print element structure according to claim 32, wherein the clapper armature pivoting hinge support is formed by an elastic strand with an O cross-section.

34. The supported print element structure according to claim 32, wherein the front casing part is fixed with at least one rib, where the rib engages into a groove-shaped recess at the profile rod.

35. The supported print element structure according to claim 32, wherein the front casing part and the profile rod are disengageably connected to each other by way of one or several spring bands.

36. The supported print element structure according to claim 30, wherein a recess, in which the clapper armature engages with a tongue, is disposed in an arm of the magnetic yoke.

37. The supported print element structure according to claim 30, wherein the arm springs are connected to each other in line direction.

38. The supported print element structure according to claim 30, wherein the second spring arm of the arm spring forms the lateral guide having a U-shape and surrounding the armature cross-section, and facing the clapper armature.

39. The supported print element structure according to claim 38, wherein the spring arm of the arm spring, facing away from the clapper armature, is furnished with openings for the passage of the print elements.

40. The supported print element structure according to claim 30 further comprising a tongue disposed at the clapper armature, wherein the tongue is disposed perpendicular to a longitudinal extension of the clapper armature and wherein the tongue engages into a recess and said recess thereby providing a guide to the tongue.

* * * * *